US007472739B2

(12) United States Patent
Heidenreich

(10) Patent No.: US 7,472,739 B2
(45) Date of Patent: Jan. 6, 2009

(54) SHADE STRUCTURES

(75) Inventor: David C. Heidenreich, Akron, OH (US)

(73) Assignee: PT Tech, Inc, Sharon Center, OH (US)

( * ) Notice: Subject to any disclaimer, the term of this patent is extended or adjusted under 35 U.S.C. 154(b) by 391 days.

(21) Appl. No.: 10/977,749

(22) Filed: Oct. 29, 2004

(65) Prior Publication Data

US 2006/0090858 A1 May 4, 2006

(51) Int. Cl.
*E06B 9/08* (2006.01)

(52) U.S. Cl. ..... 160/122; 160/68; 160/265

(58) Field of Classification Search ..... 160/122, 160/120, 265, 310, 319, 54, 66, 68, 61, 76, 160/179; 135/97, 903; 52/63; 47/22.1; 136/245
See application file for complete search history.

(56) References Cited

U.S. PATENT DOCUMENTS

| | | | | | |
|---|---|---|---|---|---|
| 422,379 | A * | 3/1890 | Clark | 160/122 |
| 673,779 | A * | 5/1901 | Morgan | 160/265 |
| 2,140,220 | A * | 12/1938 | Colvin, Jr. | 135/92 |
| 2,754,899 | A * | 7/1956 | Karobonik et al. | 160/23.1 |
| 2,974,442 | A * | 3/1961 | Womelsdorf | 47/32 |
| 4,252,172 | A * | 2/1981 | Pommat et al. | 160/322 |
| 4,574,160 | A * | 3/1986 | Cull et al. | 136/245 |
| 4,636,579 | A * | 1/1987 | Hanak et al. | 136/245 |
| 5,433,259 | A | 7/1995 | Faludy | 160/67 |
| 6,012,505 | A * | 1/2000 | Wurz et al. | 160/66 |
| 6,233,881 | B1 | 5/2001 | Rainbolt | 52/83 |
| 6,380,477 | B1 * | 4/2002 | Curtin | 136/244 |
| 6,484,069 | B2 | 11/2002 | Osinga | 700/275 |
| 6,525,263 | B2 | 2/2003 | Muller | 136/244 |
| 6,619,726 | B2 | 9/2003 | Jones | 296/163 |
| 6,812,397 | B2 * | 11/2004 | Lambey | 136/245 |
| 2004/0055633 | A1 | 3/2004 | Lambey | 136/244 |

FOREIGN PATENT DOCUMENTS

BE 1015160 A * 10/2004

* cited by examiner

*Primary Examiner*—Blair M. Johnson
(74) *Attorney, Agent, or Firm*—Renner, Kenner, Greive, Bobak, Taylor & Weber

(57) ABSTRACT

Shade structures include awning fabrics carried by awning rolls from which they may be extended to provide shade to areas, and into which they may be retracted when shade is not needed. Closed systems are disclosed in which one or more awning fabrics can be extended through a single drive system. In particular embodiments, the shade structures cover large surface areas and include solar cells for the generation of photovoltaic power.

13 Claims, 9 Drawing Sheets

SHADE STRUCTURES

TECHNICAL FIELD

The present invention generally relates to structures for providing shade, and, in particular embodiments, relates to extendable and retractable shade structures having cost effective designs for providing shade to large areas. In specific embodiments, the extendable and retractable shade structures include solar cells for generating photovoltaic power.

BACKGROUND OF THE INVENTION

While shade structures exist, and are provided in many environments, they tend to be rigid, expensive, and permanent or time consuming to erect. This is especially true for shade structures for shading large areas, which tend to take the form of permanent rigid structures, as in, for example, a pavilion constructed out of wood, as might be seen at a public park. The permanent construction of or selective setting up and tearing down of a shade structure increases the cost thereof, making the provision of shade in some areas impractical. Because there are many areas that would benefit from being better shaded, there exists a need in the art for new efficient designs for the provision of shade structures.

Shades for large areas are of particular interest. In sunny areas, motor vehicles sitting out in the sun, for instance, in parking lots, become extremely hot and uncomfortable after a few minutes time, and can remain that way for the first few minutes of operation, until an air conditioner is put to use or until cooling air circulates through open windows. The discomfort of entering a hot vehicle left in the sun is well known to everyone, even in moderate climates. The vehicles become so hot, in fact, that it is well know that pets and children can suffer injury and even death from being left in a car in hot weather. Yet very few parking lots are shaded, due to the cost of the structure that must withstand wind loads of 70 mph winds and higher.

Retractable shade structures, such as awnings, provide a cost-effective, lightweight method of shading small areas. They can be retracted automatically when high wind speed is detected. Retractable awnings have typically been used to extend from the sides of buildings and generally have an extendable limit of less than five meters. They are typically extended from the same side on which they are mounted. To cover large areas with a retractable awning will require that the typical extension distance to be greatly increased, at least by a factor of 2 or 3, and perhaps as much as 5 to 10. A new and novel structure is needed to achieve this.

For larger structures, the tensioning of the shade structure is important, because a shade structure that is not sufficiently taut may be easily damaged or otherwise compromised by weather and wind conditions. Thus, there further exists a need for shade structures that are configured to achieve sufficient tensioning to remain structurally sound in at least moderate weather conditions, although it is envisioned that such shade structures could be beneficially retractable to protect them against more severe conditions.

Of particular interest are retractable awnings that extend from a roll. And as a large retractable awning is extended further from the roll, the need to maintain and control proper tension within the awning fabric becomes more important. There is a need in the art for a novel structure to ensure proper tensioning throughout its extendable range. The longer extension distances also necessitate an automatic retraction ability to prevent damage in high winds. Preferably such retraction could be accomplished without the need for power. There is a need in the art for improved automatic retraction methods for large retractable awnings.

Further, there is a need to cover large areas with solar cells that can generate photovoltaic power. Traditional solar cells have been the rigid crystalline silicon type, which require rigid structures, such as the roofs of buildings, on which to be mounted. Some such structures have been used for parking areas, but the cost of the structure with the cost of the traditional solar cells have been prohibitive.

New solar cells are on the verge of commercialization that can be printed or fabricated inexpensively with roll-to-roll technology onto thin flexible fabrics or polymers. The combination of these low-cost, lightweight flexible solar cells to a low-cost retractable shade structure could provide an economical solution to the mounting energy and global warming problems. Photovoltaic power is widely recognized as one of the most environmentally attractive of all energy sources, but the structures and methods for employing solar cells that produce photovoltaic power have not yet proved viable. Thus, there is a need in the art for a novel structure to electrically connect the solar cells on a large rotatably retractable awning.

SUMMARY OF THE INVENTION

In one embodiment, this invention provides a shade structure including a rotatable awning roll, an awning fabric, a cable take-up, a cable, and solar cells on the awning fabric for generating photovoltaic power. The awning fabric has a distal movable end and a fixed end, with the fixed end being connected to the rotatable awning roll. The cable connects between the distal movable end of the awning fabric and the cable take-up, which is operable to extend the awning fabric from a retracted state, in which it is wound about said rotatable awning roll, to an extended state, in which the distal movable end is extended at a distance from the rotatable awning roll, by retaining at least a portion of the cable. The solar cells wind about the rotatable awning roll with the awning fabric.

In another embodiment, this invention provides a shade structure including a rotatable awning roll, an awning fabric, a cable take-up drum, a cable, and a cable guide distanced from said rotatable awning roll. The cable take-up drum is associated with the rotatable awning roll to rotate therewith. The awning fabric has a distal movable end and a fixed end, with the fixed end being connected to the rotatable awning roll. The cable extends from the distal movable end of the awning fabric around the cable guide and back to connection to the cable take-up drum, which is operable to extend the awning fabric from a retracted state, in which it is wound about said rotatable awning roll, to an extended state, in which the distal movable end is extended at a distance from the rotatable awning roll, by retaining at least a portion of the cable. The cable take-up drum rotates with the rotatable awning roll, and the simultaneous rotation of the rotatable awning roll and the cable take-up drum causes the cable to be taken up on the cable take-up drum, at the same time causing the awning fabric to be pulled off of the rotatable awning roll toward its extended state.

In embodiments including multiple awning fabrics, this invention provides a shade structure including first and second shade supports in spaced relation to one another. The first shade support includes a first shade roll, having a first rotatable awning roll, and a second cable take-up. The second shade support structure includes a second shade roll, having a second rotatable awning roll, and a first cable take-up. The first shade support includes a first awning fabric having a distal movable end and a fixed end, the fixed end being connected to the first rotatable awning roll such that the first awning fabric is movable between a retracted state in which it is wound about the first rotatable awning roll and an extended state in which the distal movable end is extended at a distance from the first rotatable awning roll. The second shade support includes a second awning fabric having a distal movable end and a fixed end, the fixed end being connected to the second rotatable awning roll such that the second awning fabric is movable between a retracted state in which it is wound about the second rotatable awning roll and an extended state in which the distal movable end is extended at a distance from the second rotatable awning roll. A first cable connects between the distal movable end of the first awning fabric and the first cable take-up, which is operable to extend the first awning fabric from the retracted state to the extended state by retaining at least a portion of the first cable. A second cable connects between the distal movable end of the second awning fabric and the second cable take-up, which is operable to extend the second awning fabric from the retracted state to the extended state by retaining at least a portion of the second cable.

In a more particular embodiment including multiple awning fabrics as above, the cable take-ups are take-ups drums, the second cable take-up drum is associated with the first rotatable awning roll to rotate therewith, and the first cable take-up drum is associated with the second rotatable awning roll to rotate therewith, such that the simultaneous rotation of the first rotatable awning roll and the second cable take-up drum causes the second cable to be taken up on the second cable take-up drum, at the same time causing the second awning fabric to be pulled off of the second rotatable awning roll toward its extended state, and causes the first cable to be taken up on the first cable take-up drum, at the same time causing the first awning fabric to be pulled off of the first rotatable awning roll toward its extended state.

PREFERRED EMBODIMENT FOR CARRYING OUT THE INVENTION

The present invention provides shade structures that will be useful for covering significant surface area. This invention is focused upon, but not particularly limited to providing shade structures that have flexible solar cells incorporated into the shade fabric to generate photovoltaic power. As used herein, "solar cells" are to be understood as encompassing any device capable of receiving light and converting it to useful electric current, including those devices currently known and those to be produced in the future. While endeavoring to provide photovoltaic shade structures that provide photovoltaic power, it was deemed necessary to provide shade structures that can be efficiently constructed, erected, and maintained in order that the costs associated with the photovoltaic shade structure would not exceed the value of the potential for generating photovoltaic power. It is believed that these shade structures will be desirable even without the potential for creating photovoltaic power, and, therefore, useful shade structures are disclosed herein both with and without solar cells, although it should be appreciated that every shade structure disclosed herein could include solar cells and other appropriate associated elements. It was also found to be necessary to have sufficient tension in the shade material itself, as the shade must be capable of withstanding significant wind forces. Shade structures for producing photovoltaic power also must be able to respond to weather conditions to retract when sufficient sunlight is not available, and retract when weather conditions threaten the structural integrity or function of the shade structure.

Figure 1:
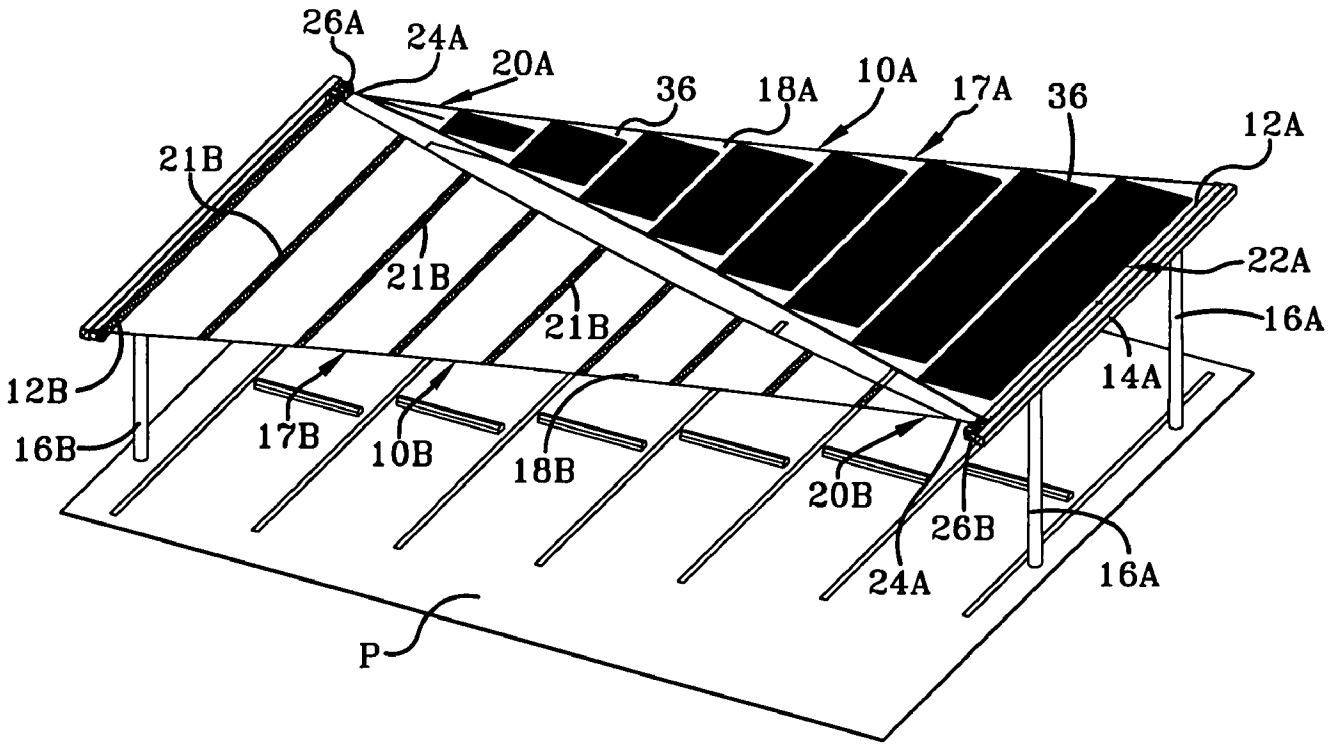
FIG. 1 is a perspective view of two shade structures according to one embodiment this invention.

With reference to FIG. 1, two identical shade structures in accordance with this invention are shown side-by-side and designated by the numerals 10A and 10B. It should be appreciated that it is not necessary to practice this multi-shade structure embodiment, and, thus, one shade structure is first disclosed and distinguished by the use of the letter "A" after each numeral designation of its elements.

A single shade structure 10A includes a rotatable awning roll 12A carried by a support 14A on posts 16A. Rotatable awning roll 12A carries an awning fabric 18A having a distal end 20A and a fixed end 22A. Fixed end 22A is connected to rotatable awning roll 12A, which, as its name implies, is able to rotate such that awning fabric 18A may move between a retracted state, wherein it is wound about rotatable awning roll 12A, and an extended state, wherein distal end 20A is extended at a distance from rotatable awning roll 12A. A cable 24A is connected between distal end 20A and a cable take-up 26A. Cable take-up 26A, as its name implies, is selectively operable to take in cable 24A to extend awning fabric 18A to the extended state shown in FIG. 1. In a particular embodiment, cable take-up 26A is a powered winch that rotates to take up cable 24A, thereby extending fabric 18A.

Figure 2:
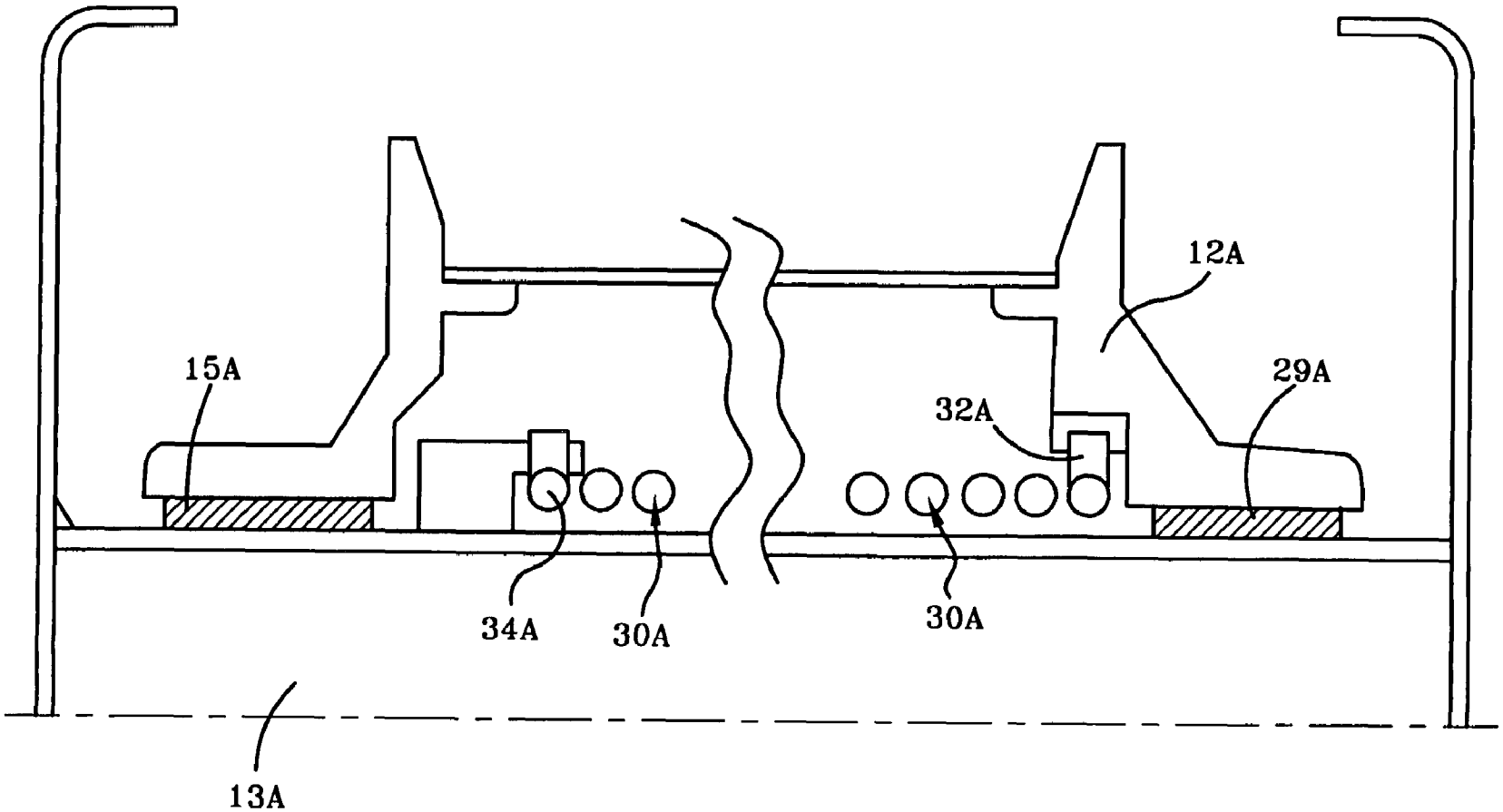
FIG. 2 is a partial cross section of an embodiment of an awning roll, showing the awning roll received on a stationary spindle and communicating therewith through a torsional spring.

With reference to FIG. 2, it can be seen that, in one embodiment, rotatable awning roll 12A rotates on an inner stationary spindle 13A, at bearings 15A, and a torsional spring 30A is connected to rotatable awning roll 12A, at biased end 32A, and to stationary spindle 13A, at grounded end 34A. Biased end 32A is secured to awning roll 12A to rotate therewith. It will be appreciated that torsional spring 30A will serve to maintain tension in awning fabric 18A, as the cable take-up 26A takes in cable 24A to extend awning fabric 18A. For large shade structures encountering wind and other elements, a winch cable take-up embodiment will require an exceptionally strong and flexible torsional spring and substantial power to drive the winch in order to maintain the tension necessary in the fabric to support the weight and wind load of the awning fabric. This is especially true in particular embodiments beneficially employing solar cells and wiring, at the preferred sizes, such as those described below.

Shade structure 10B is shown as having generic awning fabric 18B that simply serves to block light. But in preferred embodiments, the awning fabrics include solar cells. Thus, awning fabric 18A is shown as including solar cells in the exploded view of a portion of fixed end 22A and awning roll 12A provided in FIG. 3. This is an exploded view of the upper right portion of structure 10A shown in FIG. 1. Solar cells are designated by the numeral 24. Preferably, solar cells 24 are provided in axial sections, as designated at 36, and connect between positive secondary wire 26 and negative secondary wire 27 that run axially (relative to awning roll 12A) and connect to positive primary wire 29 and negative primary wire 28, respectively. Primary wires 28 and 29 run back to rotatable awning roll 12A, at fixed end 22A, and solar cells 24, secondary wires 26 and 27, and primary wires 28 and 29 wind onto rotatable awning roll 12A with the awning fabric 14A in which they are incorporated. Fabric 18A is preferably defined by side edges 17A, 19A (see FIG. 1) that extend at an angle of less than 90° from the axis of rotatable awning roll 12A. Primary wires 28 and 29 extend proximate and substantially parallel to one or more of these edges 17A, 19A, such that primary wires 28 and 29 do not overlap when awning fabric 18A is wound on awning roll 12A.

Figure 3:
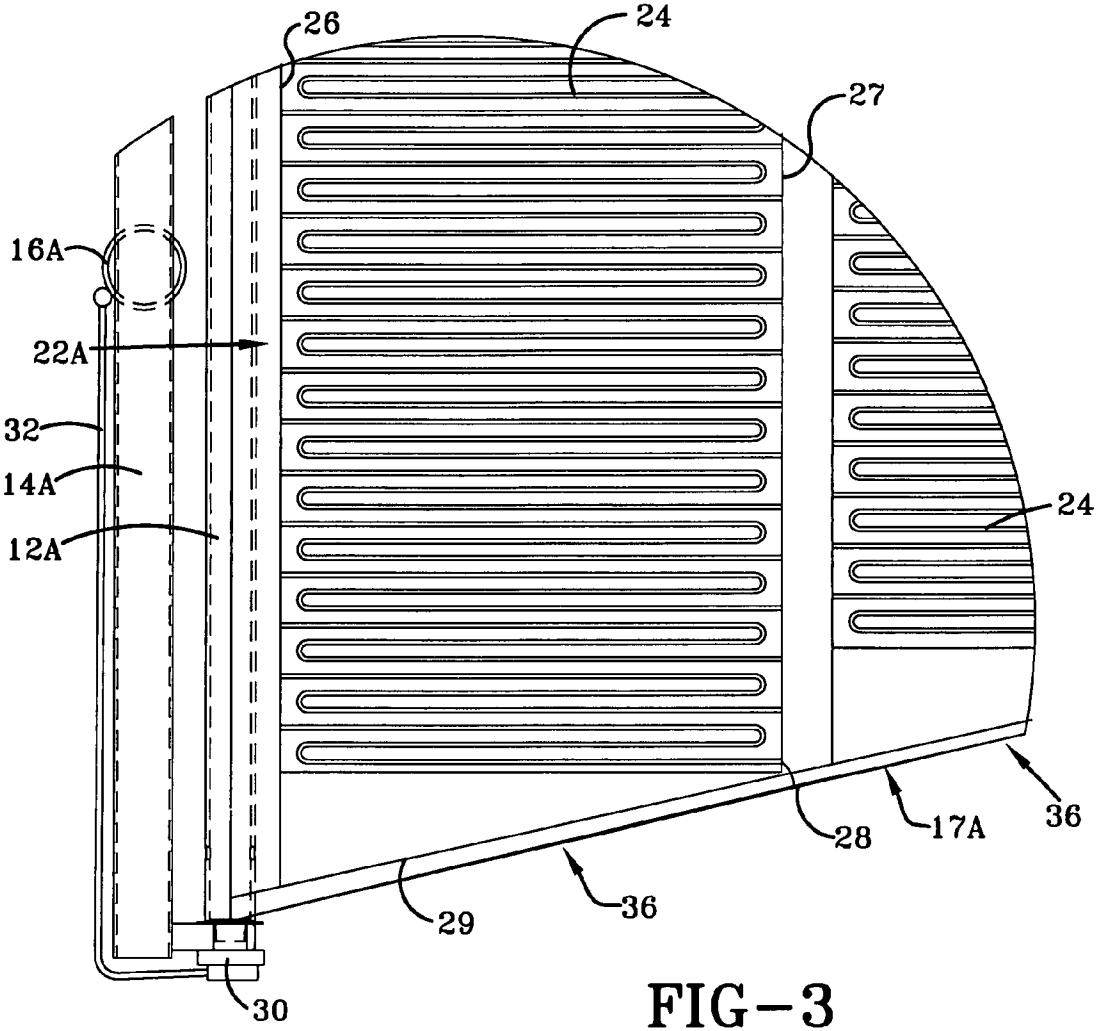
FIG. 3 is an exploded top plan view of a portion of a shade structure of FIG. 1, showing aspects of the optional incorporation of solar cells therein for the production of photovoltaic power.

At awning roll 12A, primary wire 28 communicates with a slip ring 30 for carrying current generated by solar cells 24. Slip rings 30 are commonly used to transfer electric current between a rotating member and a stationary member such as in cable reels, generators, motors, etc. with individual rings for positive and negative and optionally for ground. The rings may be oriented radially or axially as is well known in the art. In a known manner, slip ring 30 communicates with positive and negative primary wires 29, 28 through carbon brushes to which stationary wiring 33 is attached to carry current to an appropriate location. In FIG. 3 it is shown that a wire 32 carries current down support 16A. This would pass to an inverter (to convert photovoltaic DC current to AC) for local power needs or to a power grid. It is envisioned that when such structures are employed in parking lots, the current could be carried to a local charging unit for charging electric or hybrid vehicle batteries. It should be appreciate that while only one edge 17A is shown in FIG. 3, primary wires 28 and 29 could alternatively or additionally be provided at edge 19A, with appropriate communication with a slip ring and other elements. The solar cells 24 are discussed here with respect to shade structure 10A, but it should be noted that they might be employed in any shade structure embodiment disclosed herein. The application of solar cells 24 to such other embodiments will be apparent from the forgoing and following disclosures.

In a particular embodiment, solar cells 24 are the flexible thin film type that are presently made in small sizes for providing power to portable devices. Such solar cells are presently made by Iowa Thin Film of Ames, Iowa. Currently, several companies are on the verge of commercializing larger low-cost flexible thin film solar cells using roll-to-roll printing or coating processes onto flexible polymer materials. This includes titanium dioxide based solar cells presently being introduced by Konarka of Lowell, Mass. (www.Konarka-.com), and Solar Ply™ solar cells being introduced by Nanosolar of Palo Alto, Calif. (www.nanosolar.com). These flexible thin film type solar cells 24 would typically consist of multiple individual solar cells that are printed or coated onto a polymer film. Each individual solar cell would output very little voltage and current, thus multiple cells would be arranged on panels (like axial sections 36). In such panels (sections 36), the cells would be arranged in series, to multiply the voltage of each cell, and in parallel, to multiply the current of the cells to the limits of the conductors that can be imprinted or coated on the solar cell panel. These conductors would attach to the secondary wires 26 and 27 in multiple places on each solar cell section 36.

Shade structure 10B is shown without solar cells, and awning fabric 18B includes open mesh areas 21B that run axially relative to awning roll 12B in FIG. 1, although they could be placed at other areas and in other configurations. These mesh areas 21B attenuate the effects of wind on the awning fabric 18B, and may be beneficially employed in conjunction with solar cell axial sections, such as sections 36.

Two side-by-side shade structures are shown in FIG. 1, because such a construction, together with the preferred tapered design of the awning fabrics, provides a composite shade structure that can cover substantial surface area. Further, it should be appreciated from FIG. 1 that multiple shade structures such as shade structures 10A and 10B can be positioned to cover additional surface area, and such shade structures may or may not include solar cells, as desired. In shade structure 10B, like parts have received like numerals and function substantially as described with respect to structure 10A. In the particular embodiment of FIG. 1, supports 14A and 14B are spaced from each other on their respective posts 16A and 16B. Support 14A carries rotatable awning roll 12A, as already described, and additionally carries cable take-up 26B, which takes in cable 24B and is thus selectively operable to extend awning fabric 18B to the extended state shown in FIG. 1. With both cable take-up 26A and 26B selectively operated to extend both fabrics 18A, 18B, a composite parallelogram shape is made, and can be employed to efficiently cover parking spaces P, being particularly useful in covering those parking spaces configured at an angle.

Although not limited to any size constraints, it is envisioned that awning rolls of from 3 to 30 meters (m) in axial length will be desirable, especially for the incorporation of solar cells and the potential for generating photovoltaic power. Preferably, the awning rolls will range in length from about 4 to about 20 m, and, more preferably, from 5 to 15 m. This is generally the width of the fixed end of an awning fabric. Although not limited to triangular structures, the awning fabrics preferably have side edges that extend from the distal end fixed to the awning roll at an angle of from about 45 to about 89°. More preferably, the angle is from 50 to 87°, and, in particularly preferred embodiments, from 65 to 85°. As will be seen, particularly preferred are triangular or trapezoidal in shape, and the extendable length of the fabrics may range from about 3 to 50 m, more preferably from 4 to 35 m, and, in particular embodiments, from 5 to 20 m. Within these size ranges, individual awning fabrics are large enough to cover from about 10 to about 1000 $m^2$, more preferably, from 15 to 600 $m^2$, and, in particular embodiments, from 25 to 300 $m^2$. It will be appreciated that, at these preferred sizes, suitable torsional springs for mounting the awning roll could be vary expensive, particularly in embodiments such as that in FIG. 1, wherein the torsional spring is the main means of taut retraction. Thus, although FIG. 1 provides a useful shade structure, other structures are proposed herein with improved tension, extension and retraction capabilities. But a drive system applicable to all embodiments is first disclosed.

Figure 4:
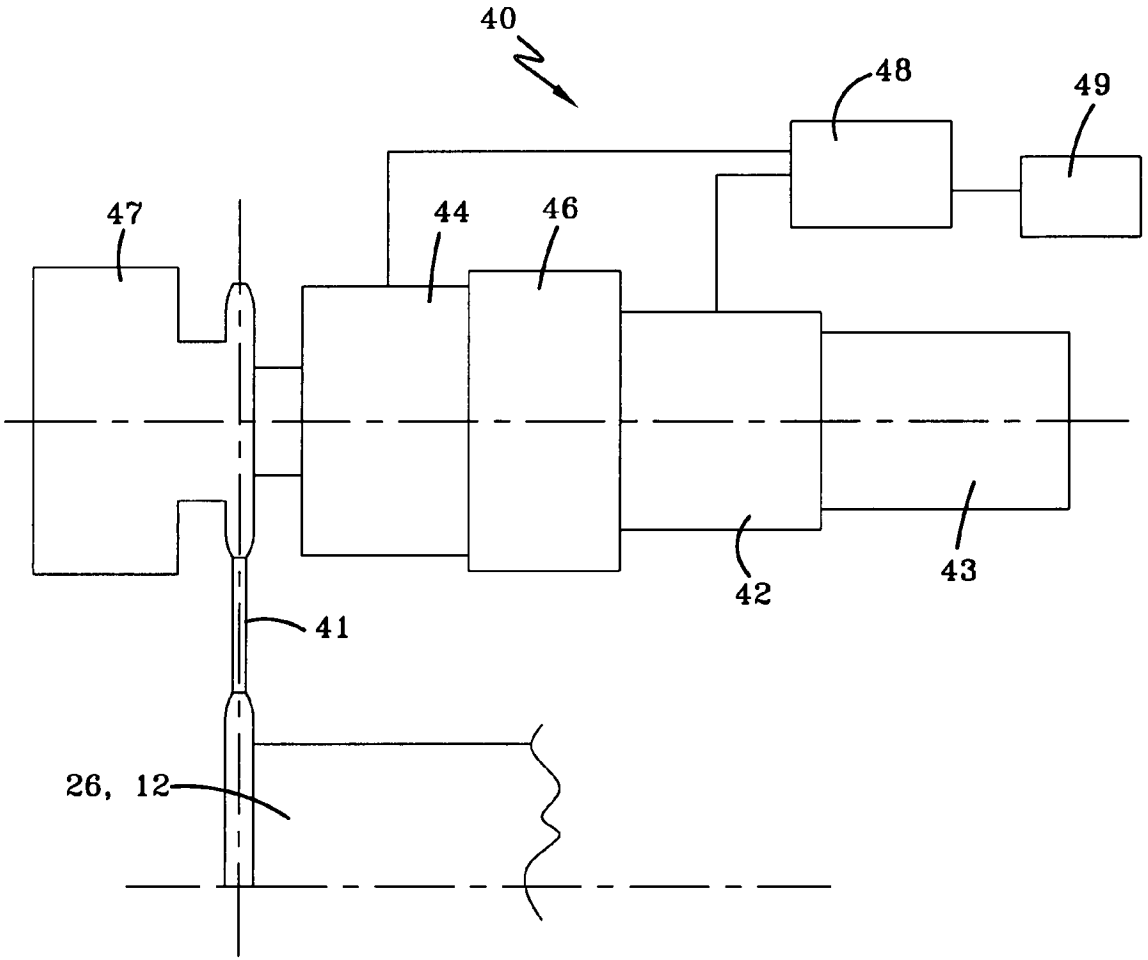
FIG. 4 is a schematic view of a drive system that may be employed with the various shade structure embodiments of this invention.

Referring now to FIG. 4, a general schematic for a preferred awning drive system of the embodiment of FIG. 1 is shown and designated by the numeral 40. The specifics of such a drive system 40 will be well within the skill of those familiar with the technology involved. Drive system 40 is shown here as being coupled to either a cable take-up 26 or an awning roll 12, by means of designating the general structure to which system 40 is coupled as 26/12. The "A" and "B" designation are dropped in FIG. 4, because it will be appreciated that the drive system 40 can be employed with either or both of shade structures 10A and 10B. Particularly, in FIG. 1, two drive systems 40 would preferably be employed, with a first drive system coupled to cable take-up 26A, and a second drive system cable take-up 26B, each system serving to drive their respective winch cable take-up 26A, 26B and pull their respective fabric 18A, 18B off of awning roll 12A, 12B. In an embodiment of a shade structure such as that in FIG. 1, drive system 40 is coupled to a cable take-up 26 in order to drive cable take-up 26 to extend an associated awning fabric. But in other embodiments disclosed below, drive system 40 could be coupled with an awning roll, such as roll 12, and reference is made back to FIG. 4 when disclosing such embodiments, thus making the 26/12 designation applicable.

Referring to FIG. 4, and applying the system herein to the embodiment of FIG. 1, a drive system 40 is coupled to winch cable take-up 26 through coupling 41, and such a connection is shown in FIG. 4. Coupling 41 maybe any suitable operative coupling, and, by way of non-limiting examples, may be selected from a chain, cog belt, gearing or direct in-line coupling. In FIG. 4, motor 42 drives cable take-up 26, through speed reducer 46 (if desired), and once the awning fabric associated therewith is extended to a desired length, brake 43, typically a spring-applied holding brake, holds the awning fabric at that extension. If brake 43 is released, either a slow retraction or a fast retraction is possible. A slow retraction is to be employed when there is no reason, such as high winds or other adverse weather conditions, to quickly retract the awning fabric. This slow retraction is achieved by maintaining the retraction clutch 44 in engagement between coupling 41 and motor 42, and allowing motor 42 to effect a regenerative braking function against the pull of the torsional spring associated with the awning fabric and its awning roll, such as torsional spring 30 of FIG. 2. For a fast retraction, clutch 44 is released, releasing the coupling between motor 42 and cable take-up 26, and allowing the torsional spring associated with the awning fabric and awning roll (e.g., FIG. 2) to wind the awning fabric on the roll. A retarding brake 47 serves to slow the retraction of the awning fabric against the pull of the spring. Controller 48 serves to control motor 42 and clutch 44, and can thus effect either a slow or fast retraction. In particularly preferred embodiments of this invention, controller 48 receives input from a sensor 49 that monitors weather conditions (wind, sunlight, other ambient conditions) and/or forces acting on the system. Based upon the input from sensor 49, controller 48 selectively causes the extension or retraction of an awning fabric, and controller 48 also controls whether such retraction is fast or slow. For example, if sensor 49 sends input to controller 48 relating to high-speed winds or high tension within the system, controller 48 will effect a fast retraction to protect the fabric (as well as any solar cells thereon, if any). Sensor 49 could include solar cells that power controller 48, and, in such an embodiment, sensor 49 could communicate with controller 48 in such a manner that, when there exists insufficient sunlight conditions for providing shade and/or photovoltaic power, power to controller 48 would be cut off, allowing for the retraction of the awning fabric(s).

Figure 5:
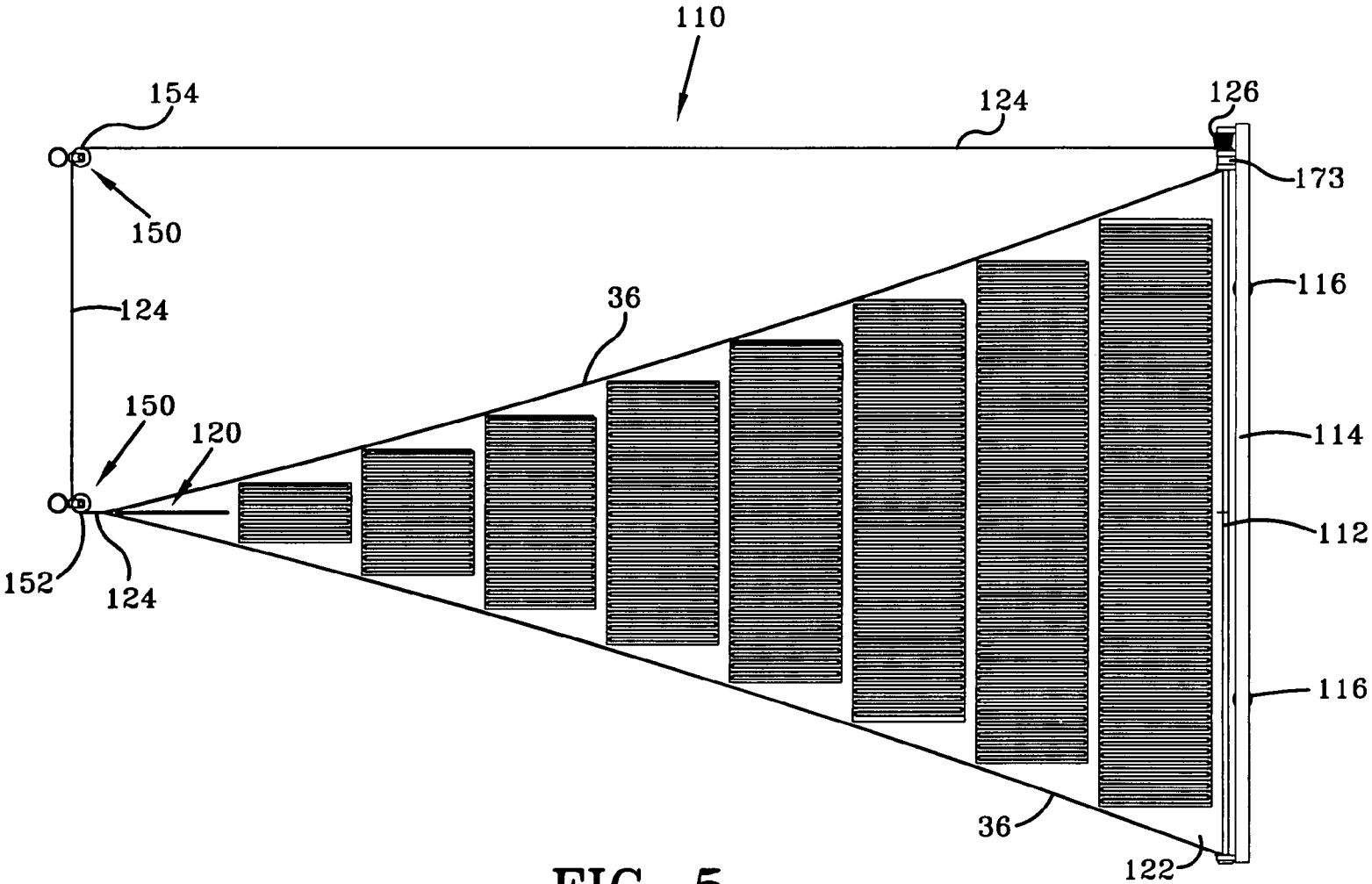
FIG. 5 is a top plan view of another embodiment of a shade structure according to this invention.
Figure 6:
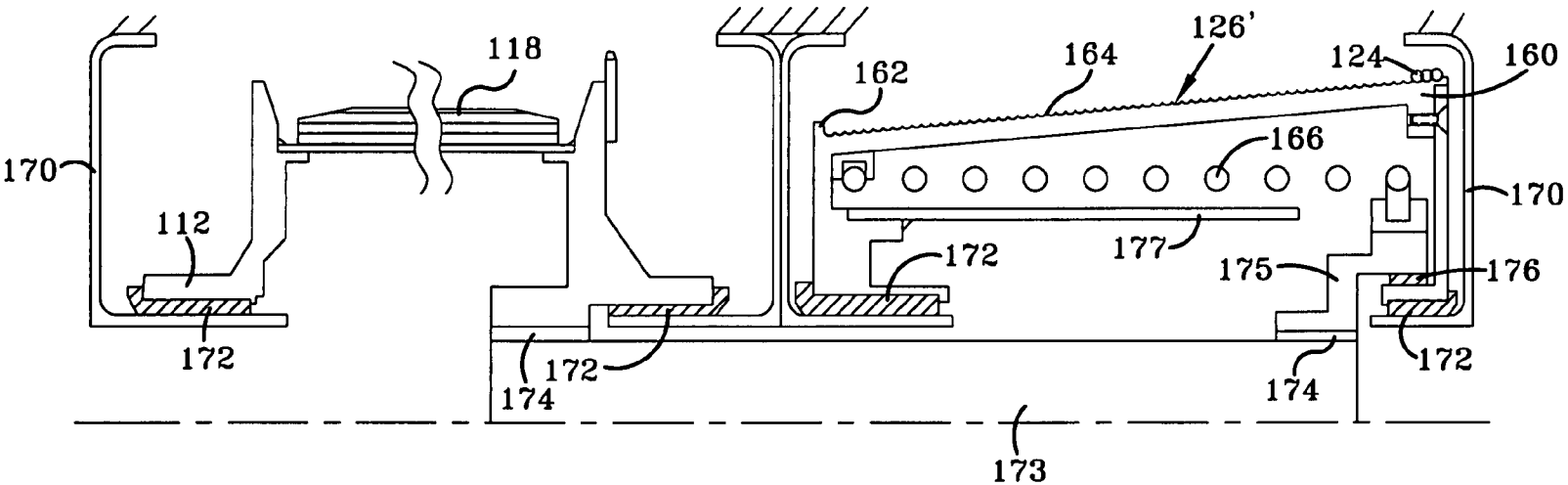
FIG. 6 is a partial cross sectional view of a portion of the shade structure of FIG. 5, showing aspects of a take-up drum.

In another embodiment, a closed system shade structure is provided, allowing for the use of an alternative means of tensioning, allowing for the use of a less expensive torsional spring in the awning roll (or between the awning roll and a cable take-up, as will be disclosed with reference to FIG. 6), as well as a less powerful motor for the extension of the fabric against the torsional spring. Indeed, as will be seen in certain embodiments, the torsional spring such as that in FIG. 2 does not have to be employed. Referring now to FIG. 5, such a closed system shade structure is shown and designated by the numeral 110. Therein, like parts to shade structure 10 receive like numerals, though increased by 100. And cable take-up 126 is associated with rotatable awning roll 112 to rotate therewith, the drive for extension and retraction preferably being controlled by a drive, clutch and brake system such as that just described. By "rotate therewith," it is intended that, when one rotates, so does the other, although it is not necessarily intended that they rotate in the same direction, and they may be connected by coupling 173 (belts, gears, in-line couplings and the like) to allow a single drive to rotate them in either the same or opposite directions and either at the same or different speeds. A cable guide 150 is distanced from rotatable awning roll 112, and cable 124 extends from distal end 120 of awning fabric 118, around cable guide 150, and back to connection to cable take-up 126. In this particular embodiment, cable guide 150 includes pulley 152, positioned at the apex of the triangular awning fabric 118, and pulley 154 spaced from pulley 152 at the axial position of cable take-up 126. These pulleys guide cable 124 to connect between distal end 120 and cable take-up 126. Simultaneous rotation of rotatable awning roll 112 and cable take-up 126 causes cable 124 to be taken up by cable take-up 126, at the same time causing awning fabric to be pulled off of rotatable awning roll 112 toward its extended state. As used in this context, "simultaneous" does not necessarily mean at the same speed. In a particular embodiment of this invention, cable take-up 126 is a spool-like structure that takes in cable 124 as it rotates, and cable take-up 126 and awning roll 112 rotate in the same direction. With this configuration, the fabric 118 could pay out at the top of roll 112, while the cable 124 is taken in at the bottom of cable take-up 126. This invention is not necessarily limited to this configuration.

In one embodiment, the length of cable 124 taken up by cable take-up 126 is substantially the same as the length of awning fabric 118 unwound from rotatable awning roll 112, such that substantially consistent tension is maintained in awning fabric 118 during extension and retraction thereof. In the exploded partial cross-sectional view of FIG. 6, take-up 126 is a contoured take-up drum 126', having a large diameter end 160 and a small diameter end 162. The large diameter end 160 is substantially of the same diameter as the diameter provided by the awning fabric 118 when retracted on rotatable awning roll 112, and the small diameter end 162 is substantially the same diameter as the diameter provided by the awning roll 112 when the awning fabric is fully extended. The contour of drum 126' ensures that the length of cable taken up on drum 126' is substantially the same as the length of awning fabric 118 unwound from rotatable awning roll 112, despite the fact that less fabric 118 is unwound from rotatable awning roll 112 with each rotation, due to the fact that the circumference of the awning fabric 118 wound on awning roll 112 continually decreases. Additionally, drum 126' has a cable groove 164 extending around the circumference thereof from the large end 160 to the small end 162 to receive and guide cable 124 during the rotation of drum 126' and the take-up of cable 124. This is just one embodiment of a means for maintaining tension in the system. And it will be appreciated that other means could be employed. For example, the cable take up drum 126' could be smaller than rotatable awning roll 112 and, through appropriate gearing, could rotate at a faster rate to ensure proper tensioning.

By driving both rotatable awning roll 112 and cable take-up 126 at the same time, the amount of power required to extend and retain awning fabric 118 extended is substantially reduced over an embodiment in accordance with FIG. 1, wherein a separate cable take up 26 (typically a winch) is driven to pull an awning fabric 18 off of rotatable awning roll 12 against a spring 30 sufficient to keep awning fabric 18 taut. Additionally, when, in this embodiment, awning roll 112 is configured with an inner stationary spindle and torsional spring (as with spindle 13A and spring 30A, discussed above) a controlled retraction is possible upon release of an appropriate drive and clutch mechanism. The impetus to retract would be provided by the torsional spring or springs within the awning roll, and would only need to be strong enough to retract at the fastest speed necessary to protect the system from wind gusts. The torsional springs would not need to maintain tension as in the embodiment of FIG. 1. The drive to extend the awning shade needs only to overcome the torsional spring torque and whatever frictional torque there is in the system.

In another embodiment, it is desirable that the tension in the awning fabric 118 increase as it is extended, and thus, the length of cable 124 wound on cable take-up 126 is greater than the length of awning fabric 118 unwound from rotatable awning roll 112. This could be achieved, for example, by having a drum 126' with a large end 160 larger than the diameter provided by awing fabric 112 when retracted on the awning roll 112 and small end 162 larger than the diameter provided by awning roll 112 when awning fabric 118 is fully extended, with the contour of drum 126' being such that the position of cable 124 on drum 126' is at a greater radial distance from the center of rotation of drum 126' than is the position of fabric 118 on awning roll 112 relative to the center of rotation of awning roll 112. In such a closed system, the forces resulting from the tension in the extended system and acting on awning roll 112 are equal to the forces action on drum 126', and, because these forces act at a greater radial distance from the center of rotation of drum 126' than the distance that they act on awning roll 112 relative to the center of rotation thereof, the system will self-retract when any braking force serving to keep it extended is removed as the moment arm of the drum 126' is larger than the moment arm of the roll 112. Such self-retraction can be achieved without the inner spindle/torsional spring configuration of FIG. 2, and, thus, in FIG. 6, these inner spindle/torsional spring elements are not shown, although, if desired, they may be employed. The biasing force for self-retraction can be achieved by the stretch of cable 124 and fabric 118 and through deflection of the support structure 114, 116. In FIG. 6, an optional torsional spring 166 is coupled between drum 126' and awning roll 112 through hub 175 and bearing 176. Drum 126' is mounted to supports 167 on bearings 169. Roll 112 is mounted to supports 170 on bearings 172 and is coupled to drum 126' to rotate therewith at coupling splines 174 through coupling 173. Spring 166 ensures that the drum 126' and roll 112 can rotate relative to each other to control the tension built up in the system despite variations in fabric thickness, cable stretch and support structure rigidity.

Figure 7:
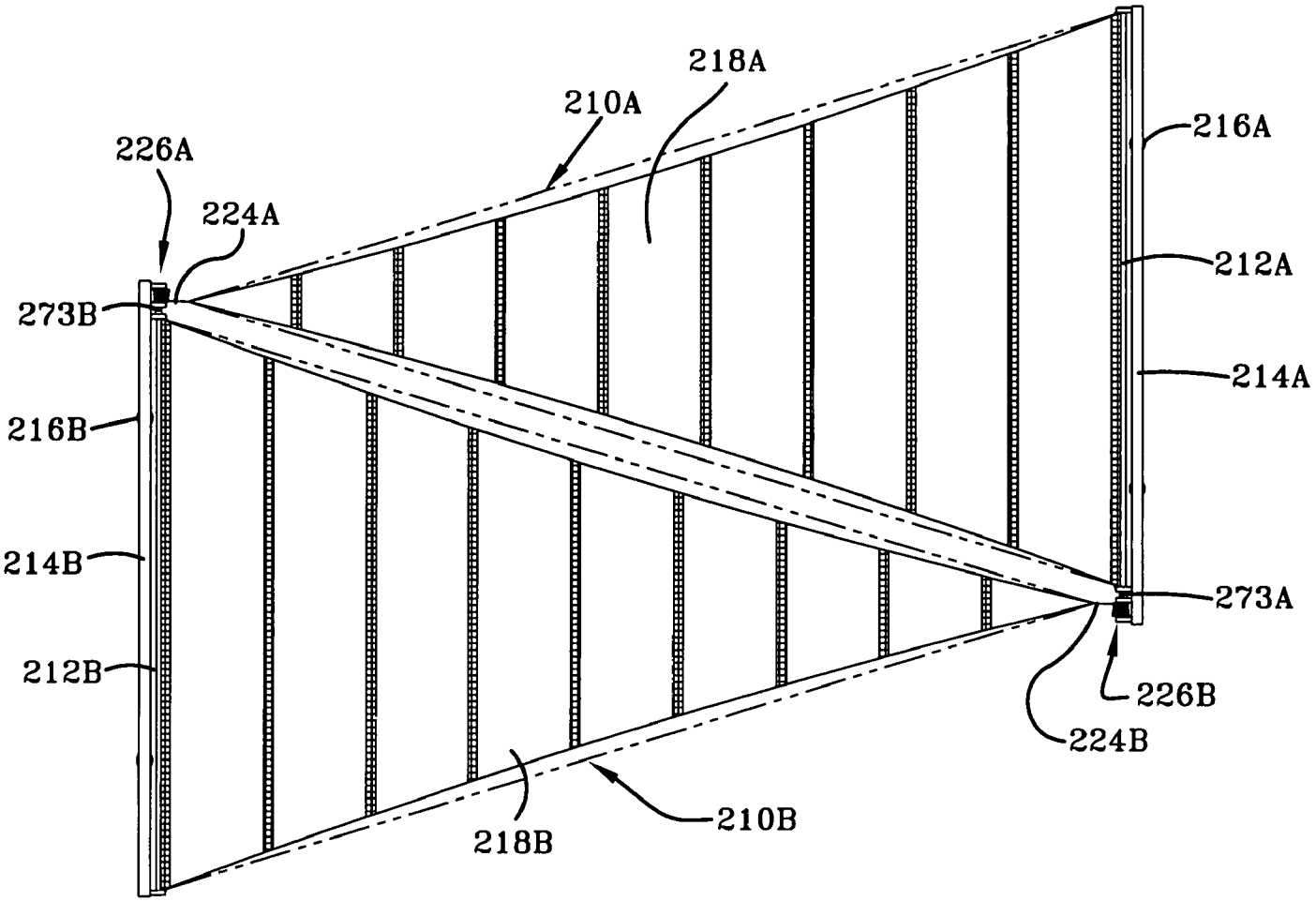
FIG. 7 is a top plan view of yet another embodiment of a shade structure according to this invention, particularly a duplex construction thereof.

The closed system concept is next expanded to cover a duplex structure in which a single drive can extend two awning fabrics from two awning rolls. Referring now to FIG. 7, a duplex shade structure is show, with two complementary shade structures 210A and 210B. Therein, like parts to shade structure 110 receive like numerals, though increased by 100, and the cable take-ups are positioned slightly differently, although they function on similar principles to cable take-up 126 (or 126'). To explain this embodiment, elements associated with the extension of a given shade structure 210A, 210B will be designated by the appropriate letter, A or B. Cable take-up 226B, which takes in cable 224B, is associated with rotatable awning roll 212A through coupling 273A to rotate therewith, the drive for such rotation preferably being controlled by a drive, clutch and brake system associated with rotatable awning roll 212A or cable take-up 226B, such as that described above. Similarly, cable take-up 226A, which takes in cable 224A, is associated with rotatable awning roll 212B through coupling 273B to rotate therewith. The single drive associated with awning roll 212A is sufficient to drive the entire system and extend both shade structures 210A and 210B because each rotating element is tied to another in a closed system. Simultaneous rotation of rotatable awning roll 212A and cable take-up 226B causes cable 224B to be taken up by cable take-up 226B, at the same time causing awning fabric 218B to be pulled off of rotatable awning roll 212B toward its extended state. This, in turn, causes the rotation of cable take-up 226A due to the fact that awning roll 212B rotates as cable take-up drum 226B pulls out fabric 218B, and awning roll 212B and cable take-up 226A are associated to rotate together. When cable take-up 226A rotates, it takes in cable 224A, and causes fabric 218A to extend.

This type of closed system can be achieved in many ways, and this invention is not limited to or by any particular manner of winding cables and fabrics on their respective cable take-ups or awning rolls. However, in a particularly preferred embodiment awning roll 212A and cable take-up 226B are associated to rotate in the same direction, as are awning roll 212B and cable take-up 226A. Awning fabric 218A winds around awning roll 212A in one direction, and cable 224B winds around cable take-up drum in the opposite direction. Awning fabric 218B winds around rotatable awning roll 212B in one direction, and cable 224A winds around cable take-up 226A in the opposite direction. Thus, when any one of the rotatable elements of this system is driven, the other rotatable elements are driven, and, due to the manner in which cables and fabric wind on these elements, the entire system extends or retracts together. A major advantage of the duplex system is that the force of the wind blowing on one awning fabric to extend it will act on the other awning fabric to retract it, such that there will be little or no tendency for extension or retraction of the closed system.

Similar to the embodiments of structure 110, the length of cables 224A, 224B taken up by cable take-ups 226A, 226B may be substantially the same as the length of awning fabrics 218A, 218B unwound from rotatable awning rolls 212A, 212B, such that substantially consistent tension is maintained in the entire system, or, alternatively, the length of cables 224A, 224B taken up by cable take-ups 226A, 226B may be slightly larger than the length of fabrics 218A, 218B unwound from rotatable awning rolls 212A, 212B, such that tension increases in the system as it is extended. The same drum take-up concepts and others may be applied.

As with shade structure 110, this duplex system achieves low power extension. If awning rolls 212A, 21B are configured with an inner stationary spindle and torsional spring (as with spindle 13A and spring 30A, discussed above) a controlled retraction is possible upon release of an appropriate drive and clutch mechanism. If the system is configured as in the disclosure of FIG. 6, with a torsional spring between the drum and the awning roll, self-retraction can be achieved without the inner spindle/torsional spring configuration of FIG. 2.

Figure 8:
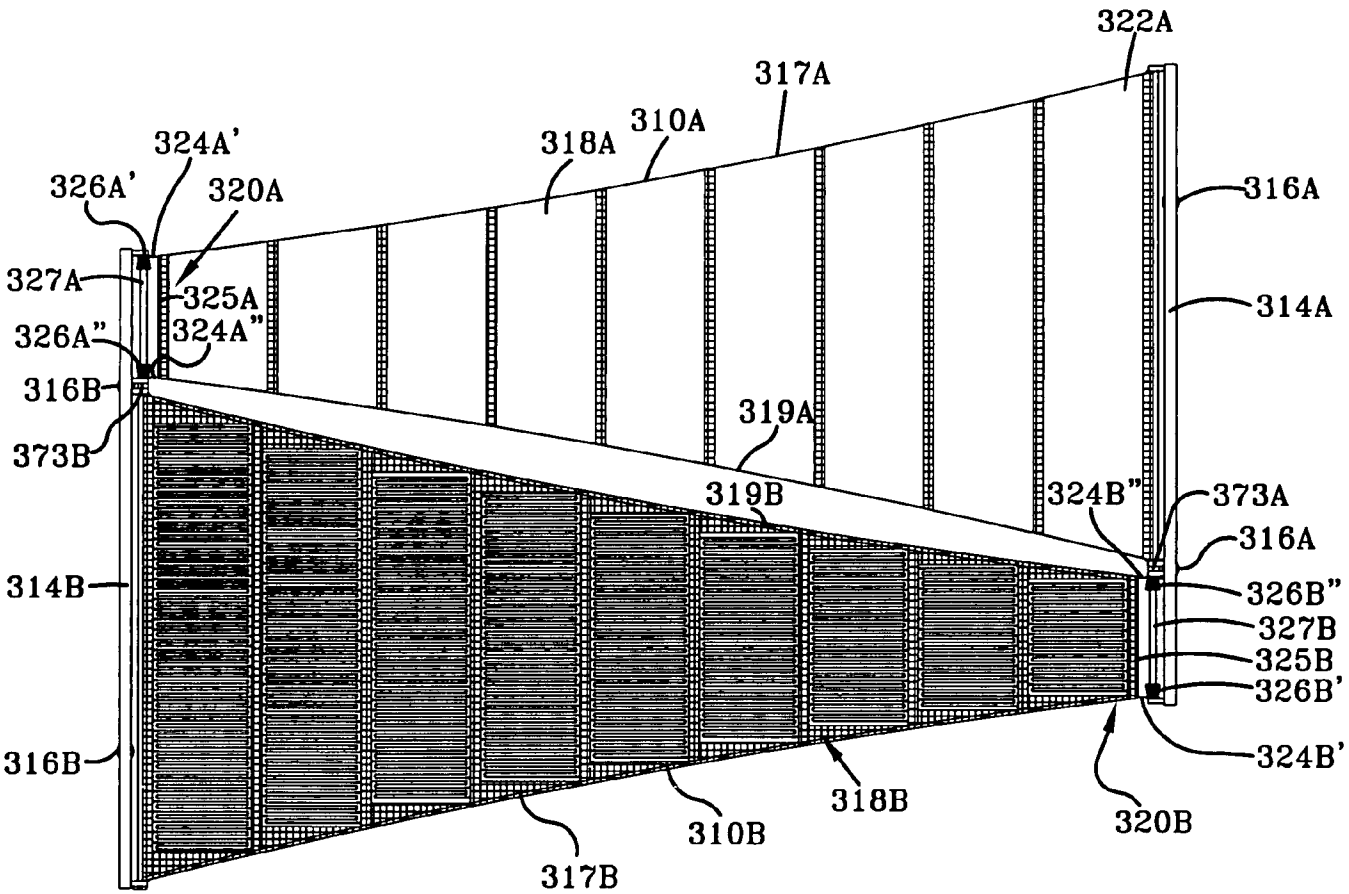
FIG. 8 is a top plan view of a trapezoidal duplex embodiment.

In FIG. 8, a duplex embodiment is shown, with two complementary shade structures 310A and 310B, having awning fabrics 318A and 318B shaped as trapezoids. Therein, like parts to shade structures 210A and 210B receive like numerals, though increased by 100, and the cable take-ups 326A and 326B take the form of cable cylinders 327A and 327B, each having two drums associated therewith. In disclosing this embodiment, shade structure 310A will be referred to, with the understanding that the disclosure also applies to 310B. The trapezoidal awning fabric 318A has a cropped distal end 320A, with two cables 324A' and 324A" extending therefrom to connection with cable take-up drums 326A' and 326A", respectively. Additional cables could be employed with additional drums on the same cylinder to provide additional stability. And an optional tensioning bar 325A could span between cable 324A' and 324A" at distal end 320A to stiffen that end. As with cable take-ups with other embodiments, cable cylinder 327A and its drums 326A' and 326A" are associated with awning roll 312B through coupling 373B to rotate therewith, cable cylinder 327B and its drums 326B' and 326B" are associated with awning roll 312A through coupling 373A to rotate therewith, and the cables and fabrics of this system are connected between their respective cable cylinders/drums and awning rolls such that a single drive associated with one of the rotatable elements is sufficient to drive the entire system and extend both shade structures 310A and 310B. Additionally, disclosures hereinabove with respect to maintaining tension or increasing tension in the awning fabrics as the system is extended also apply. That is, drums may be appropriately contoured or caused to rotate at an appropriate speed through gearing. This trapezoidal embodiment is more stable than the generally triangular embodiments previously disclosed inasmuch as there is more support at the distal ends of the fabrics. In FIG. 8, it can be seen that the side edges 317A, 319A of fabric 318A and edges 317B, 319B of fabric 318B bow slightly inwardly, such that there is a gap 390 between awning fabric 318A and 318B. This contour to the fabrics also helps to maintain tension and stability, especially during crosswinds.

Figure 9:
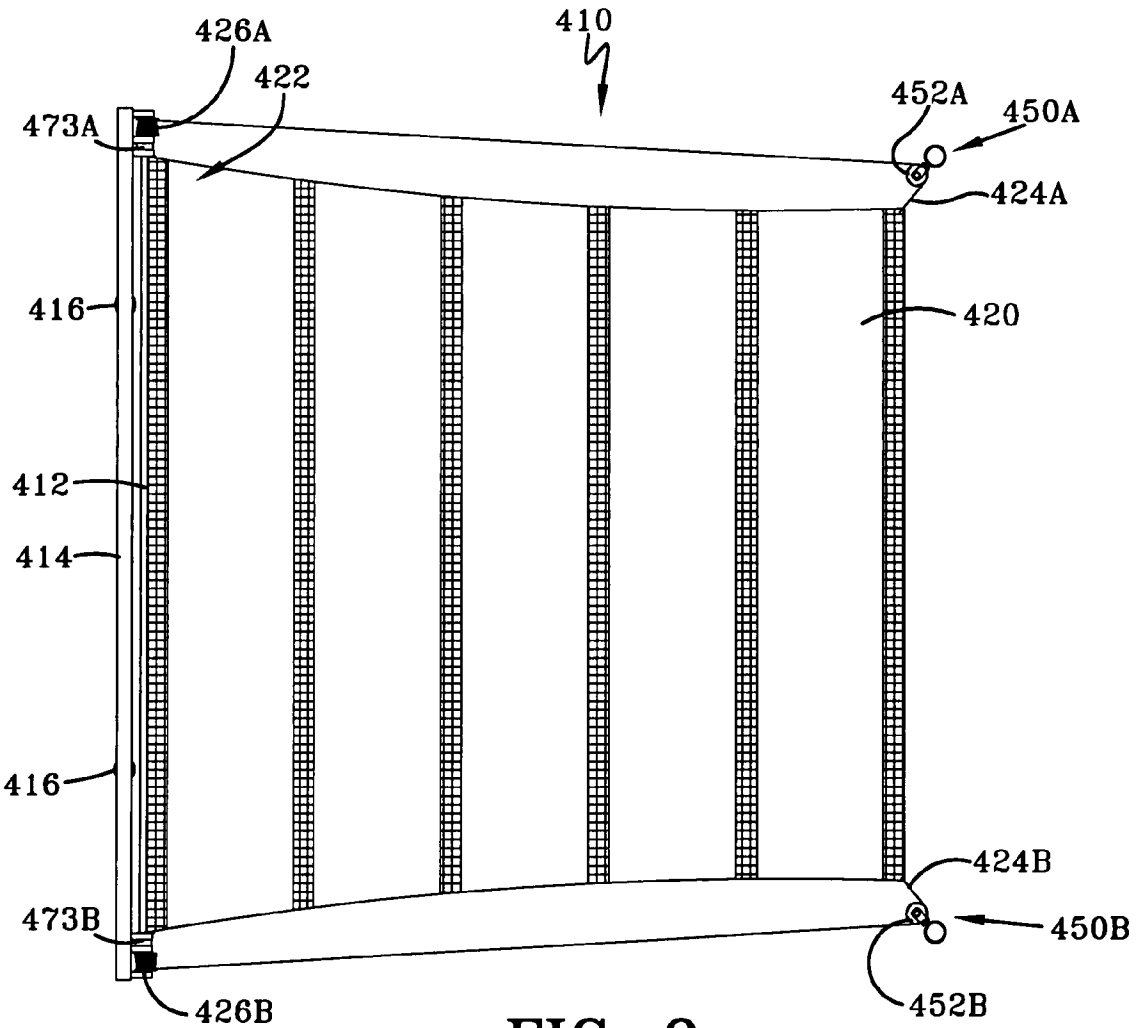
FIG. 9 is a top plan view of a trapezoid closed system shade structure that is an alternative embodiment according to this invention.

Referring now to FIG. 9, a trapezoidal closed system shade structure is shown and designated by the numeral 410. Therein, like parts to shade structure 110 of FIG. 5 receive like numerals, though increased by 100. Also, in the trapezoid embodiment of FIG. 9, two cables and two take-ups are employed, and will receive like numerals although designated with either the letter A or B to distinguish them. Thus, in this embodiment, awning fabric 418 has two cables, cable 424A and 424B extending from distal end 420. A tensioning bar 425 may optionally be employed at distal end 420 of awning fabric 418. Each cable 424A, 424B extends around its own cable guide 450A, 450B, and back to connection to its own cable take-up 426A, 426B. Although this embodiment could be configured more like FIG. 5, with multiple pulleys, cable guides 450A and 450B include only one pulley 452A, 452B, respectively. Pulleys 452A, 452B are spaced, like pulley 154 of FIG. 5, close to the axial position of their respective cable take-ups 426A, 426B. Cable take-ups 426A and 426B are associated with rotatable awning roll 412 through couplings 473A, 473B, respectively, to rotate therewith, the drive for extension and retraction preferably being controlled by a drive system such as that already disclosed. As a result, simultaneous rotation of rotatable awning roll 412 and cable take-ups 426A, 426B causes cables 424A, 424B to be taken up by cable take-ups 426A, 426B, at the same time causing awning fabric 418 to be pulled off of rotatable awning roll 412 toward its extended state.

Throughout this disclosure, various shade structures have been disclosed. It should be appreciated that aspects of one shade disclosure might be incorporated into the structure of another shade disclosure inasmuch as each independent aspect and how it might be applied in a different structure would be readily appreciated by those of ordinary skill in the art. For example, solar cells may be practiced with any embodiment, although they were specifically disclosed with respect to the embodiment of FIG. 1. Similarly, the trapezoidal awning fabrics may be practiced with any embodiment. Additionally, it should be appreciated that the structures disclosed herein might be placed in series or in parallel, with appropriate coupling mechanisms such as various in-line couplings for direct axial connections, universal joint couplings for angular axial connections, and sprockets with chain or cog belts for parallel offset connections, such that a single drive system will be able to extend and retract multiple single, closed, or duplex structures.

In light of the foregoing, it should thus be evident that this invention provides many novel features in a shade structure, and, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A shade structure comprising:

first and second shade supports in spaced relation to one another, said first shade support including:

a first shade roll having a first rotatable awning roll; and a second cable take-up drum associated with said first rotatable awning roll to rotate therewith;

said second shade support structure including:

a second shade roll having a second rotatable awning roll; and a first cable take-up drum associated with said second rotatable awning roll to rotate therewith;

a first awning fabric having a distal movable end and a fixed end, said fixed end being connected to said first rotatable awning roll such that said first awning fabric is movable between a retracted state in which it is wound about said first rotatable awning roll and an extended state in which said distal movable end is extended at a distance from said first rotatable awning roll; and a second awning fabric having a distal movable end and a fixed end, said fixed end being connected to said second rotatable awning roll such that said second awning fabric is movable between a retracted state in which it is wound about said second rotatable awning roll and an extended state in which said distal movable end is extended at a distance from said second rotatable awning roll, wherein a first cable connects between said distal movable end of said first awning fabric and said first cable take-up drum, which is operable to extend said first awning fabric from said retracted state to said extended state by retaining at least a portion of said first cable, and wherein a second cable connects between said distal movable end of said second awning fabric and said second cable take-up drum, which is operable to extend said second awning fabric from said retracted state to said extended state by retaining at least a portion of said second cable, wherein the simultaneous rotation of said first rotatable awning roll and said second cable take-up drum causes said second cable to be taken up on said second cable take-up drum, at the same time causing said second awning fabric to be pulled off of said second rotatable awning roll toward its extended state, and causes said first cable to be taken up on said first cable take-up drum, at the same time causing said first awning fabric to be pulled off of said first rotatable awning roll toward its extended state.

2. The shade structure of claim 1, wherein, during extension, the length of said first cable wound on said first cable take-up drum is substantially the same as the length of said first awning fabric unwound from said first rotatable awning roll, and the length of said second cable wound on said second cable take-up drum is substantially the same as the length of said second awning fabric unwound from said second rotatable awning roll, such that substantially consistent tension is maintained in said first and second awning fabrics during the extension and retraction thereof.

3. The shade structure of claim 1, wherein said first awning fabric has opposed tapered sides that extend along an angle of less than 90° from the axis of said first rotatable awning roll.

4. The shade structure of claim 3, wherein said opposed tapered sides of said first awning roll are bowed inwardly toward one another.

5. The shade structure of claim 1, further comprising solar cells on said first awning fabric for generating photovoltaic power, wherein said solar cells wind about said rotatable awning roll with said awning fabric.

6. The shade structure of claim 5, wherein said first rotatable awning roll includes a stationary spindle upon which said first rotatable awning roll rotates, the shade structure further comprising:

a slip ring communicating between said first rotatable awning roll and said stationary spindle and carrying electric current generated by said solar cells; and a primary wire in said awning fabric that carries said electric current to said slip ring, said primary wires extending at an angle of less that 90° from the axis of said rotatable awning roll.

7. The shade structure of claim 1, wherein said first awning fabric winds around said first rotatable awning roll in one direction and said second cable winds around said second cable take-up drum in the direction opposite to that of the winding of said first awning fabric on said first rotatable awning roll; said second awning fabric winds around said second rotatable awning roll in one direction and said first cable winds around said first cable take-up drum in the direction opposite to that of the winding of said second awning fabric on said second rotatable awning roll; said second cable take-up drum is associated with said first rotatable awning roll to rotate therewith in the same direction; and said first cable take-up drum is associated with said second rotatable awning roll to rotate therewith in the same direction.

8. The shade structure of claim 1, wherein, during extension, the length of said first cable wound on said first cable take-up drum is substantially the same as the length of said first awning fabric unwound from said first rotatable awning roll, and the length of said second cable wound on said second cable take-up drum is substantially the same as the length of said second awning fabric unwound from said second rotatable awning roll, such that substantially consistent tension is maintained in said first and second awning fabrics during the simultaneous extension and retraction thereof.

9. The shade structure of claim 8, wherein said first cable take-up drum is contoured, having a large diameter end and a small diameter end, with said large diameter end being substantially of the same diameter as the diameter provided by said first awning fabric when retracted on said first rotatable awning roll and said small diameter end being substantially of the same diameter as the diameter provided by said first rotatable awning roll when said first awning fabric is fully extended; and said second cable take-up drum is contoured, having a large diameter end and a small diameter end, with said large diameter end being substantially of the same diameter as the diameter provided by said second awning fabric when retracted on said second rotatable awning roll and said small diameter end being substantially of the same diameter as the diameter provided by said second rotatable awning roll when said second awning fabric is fully extended, thus maintaining said first and second awning fabrics under tension during extension and retraction thereof.

10. The shade structure of claim 9, wherein said first tapered drum includes a cable groove extending around the circumference thereof from said large diameter end to said small diameter end to received and guide said first cable during the rotation thereof and the take-up of said first cable, and said second tapered drum includes a cable groove extending around the circumference thereof from said large diameter end to said small diameter end to receive and guide said second cable during the rotation thereof and the take-up of said second cable.

11. The shade structure of claim 1, wherein the length of said first cable wound on said first cable take-up drum with each revolution of said first cable take-up drum is greater than the length of said first awning fabric unwound from said first rotatable awning roll with each revolution of said first cable take-up drum, and the length of said second cable wound on said second cable take-up drum with each revolution of said second cable take-up drum is greater than the length of said second awning fabric unwound from said second rotatable awning roll with each revolution of said second cable take-up drum, such that tension is increased in said first and second awning fabrics during the simultaneous extension thereof.

12. The shade structure of claim 11, further comprising:

a first torsional spring acting between said first cable take-up drum and said second rotatable awning roll.

13. the shade structure of claim 12, wherein the position of said first cable on said first cable take-up drum is at a greater radial distance from the center of rotation of said first cable take-up drum than is the position of said first awning fabric on said first awning roll, relative to the center of rotation of said first awning roll; the position of said second cable on said second cable take-up drum is at a greater radial distance from the center of rotation of said second cable take-up drum than is the position of said second awning fabric on said second awning roll, relative to the center of rotation of said second awning roll.

* * * * *